US009347018B2

(12) United States Patent
Narita

(10) Patent No.: US 9,347,018 B2
(45) Date of Patent: May 24, 2016

(54) LUBRICATING OIL COMPOSITION FOR AUTOMATIC TRANSMISSION

(75) Inventor: Keiichi Narita, Chiba (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 94 days.

(21) Appl. No.: 13/147,040

(22) PCT Filed: Jan. 28, 2010

(86) PCT No.: PCT/JP2010/051124
§ 371 (c)(1),
(2), (4) Date: Jul. 29, 2011

(87) PCT Pub. No.: WO2010/087398
PCT Pub. Date: Aug. 5, 2010

(65) Prior Publication Data

US 2011/0294708 A1 Dec. 1, 2011

(30) Foreign Application Priority Data

Feb. 2, 2009 (JP) ..... 2009-021831

(51) Int. Cl.
*C10M 169/04* (2006.01)
*C10M 135/02* (2006.01)
*C10M 141/08* (2006.01)
*C10M 161/00* (2006.01)

(52) U.S. Cl.
CPC ..... *C10M 161/00* (2013.01); *C10M 2207/028* (2013.01); *C10M 2209/084* (2013.01); *C10M 2215/28* (2013.01); *C10M 2219/046* (2013.01); *C10M 2219/085* (2013.01); *C10N 2210/02* (2013.01); *C10N 2220/022* (2013.01); *C10N 2230/02* (2013.01); *C10N 2230/06* (2013.01); *C10N 2230/54* (2013.01); *C10N 2230/68* (2013.01); *C10N 2240/042* (2013.01)

(58) Field of Classification Search
CPC ..... C10M 145/14; C10M 135/26; C10M 2209/084
USPC ..... 508/287, 331, 334
See application file for complete search history.

(56) References Cited

U.S. PATENT DOCUMENTS

| | | | | |
|---|---|---|---|---|
| 5,912,212 | A | 6/1999 | Igarashi et al. | |
| 5,972,854 | A * | 10/1999 | Ichihashi et al. | 508/433 |
| 6,051,536 | A | 4/2000 | Igarashi et al. | |
| 2003/0104955 | A1 * | 6/2003 | Yuki et al. | 508/469 |
| 2005/0170978 | A1 * | 8/2005 | Migdal et al. | 508/497 |
| 2005/0261147 | A1 * | 11/2005 | Rosenbaum et al. | 508/466 |
| 2006/0135378 | A1 * | 6/2006 | Takahashi et al. | 508/433 |
| 2007/0293408 | A1 * | 12/2007 | Opstal et al. | 508/471 |
| 2010/0035777 | A1 | 2/2010 | Sano et al. | |

FOREIGN PATENT DOCUMENTS

| | | | |
|---|---|---|---|
| EP | 0 812 900 | A2 | 12/1997 |
| EP | 2 248 876 | A1 | 11/2010 |
| JP | 53 92808 | | 8/1978 |
| JP | 9 194868 | | 7/1997 |
| JP | 9 264782 | | 10/1997 |
| JP | 9 328697 | | 12/1997 |
| JP | 10 279980 | | 10/1998 |
| JP | 2004 51758 | | 2/2004 |
| JP | 2008 179662 | | 8/2008 |
| WO | 2004 074414 | | 9/2004 |
| WO | 2005 078054 | | 8/2005 |
| WO | 2006 073198 | | 7/2006 |

OTHER PUBLICATIONS

International Search Report Apr. 27, 2010 in PCT/JP10/051124 filed Jan. 28, 2010.
Extended European Search Report Issued Feb. 14, 2013 in Patent Application No. 10735863.2.

* cited by examiner

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

A lubricating oil composition for automatic transmission including (A) a lubricant base oil having a kinematic viscosity at 100° C. of from 1.5 to 20 $mm^2/s$, (B) a polymethacrylate based viscosity index improver, and (C) a sulfur based compound having an acid value of not more than 1.0 mg-KOH/g and represented by the following general formula (1):

$$S—(CH_2CH_2COOR)_2 \quad (1)$$

(in the formula, R represents a hydrocarbon group having from 8 to 30 carbon atoms), which has a high transmission torque capacity and satisfactory gear change shock characteristics and attains excellent fuel efficiency, is provided. Also, a lubricating oil composition for automatic transmission which is a lubricating oil having a low viscosity and a high viscosity index and which, despite this, not only has excellent shear stability and fatigue resistance (durability) but has a high transmission torque capacity and satisfactory gear change shock characteristics and attains excellent fuel efficiency, is provided.

16 Claims, No Drawings

LUBRICATING OIL COMPOSITION FOR AUTOMATIC TRANSMISSION

TECHNICAL FIELD

The present invention relates to a lubricating oil composition for automatic transmission. In more detail, the present invention relates to a lubricating oil composition for automatic transmission which has a high transmission torque capacity and satisfactory gear change shock characteristics and attains excellent fuel efficiency.

BACKGROUND ART

In recent years, in order to cope with environmental issues with increased severity, a severe imposition of reduction in fuel consumption is increasing in each of the technical fields. Similarly, a more contribution to energy conservation is also strongly demanded on lubricating oils for automatic transmission.

As means for reducing fuel consumption of a lubricating oil for automatic transmission, an increase of a transmission torque capacity, namely suppression of an energy loss in a wet type clutch portion is basically important.

In general, the transmission torque capacity is attained by minimizing slippage of a wet type clutch during driving. It is meant that this is attained by a lubricating oil having a large coefficient of dynamic friction between the wet type clutches (for example, $\mu_{1800}$: coefficient of friction at the time of 1800 rpm). In consequence, it is basically required to develop such a lubricating oil for automatic transmission.

As a matter of course, in order to minimize a gear change shock, it is also indispensable to minimize (coefficient of static friction)/(coefficient of dynamic friction), for example, $\mu_{200}/\mu_{1800}$.

Furthermore, as other means for reducing fuel consumption of a lubricating oil for automatic transmission, there is a method of contriving to lower a viscosity of the lubricating oil to reduce agitating resistance, thereby contriving to enhance fuel efficiency.

However, when the viscosity of a lubricating oil is lowered, a more lowering of the viscosity is accompanied in a high-temperature region, so that capability of forming a lubricating oil film is greatly lowered. As a result, metal fatigue of a sliding member of an automatic transmission is caused, so that there is generated a concern that durability of the transmission cannot be retained, for example, impossible control of gear change, or the like.

Also, in the automatic transmission, there is a concern that a low-viscosity lubricating oil causes oil leakage in a hydraulic control part of the transmission, whereby the control of gear change becomes impossible.

In the light of the above, it is a difficult problem to make an enhancement of fuel efficiency by lowering the viscosity of a lubricating oil and an enhancement of fatigue resistance (durability) of an automatic transmission per se compatible with each other.

Furthermore, since an automatic transmission fluid is broad in a use temperature range, a lubricating oil with a high viscosity index is required. However, it is difficult to obtain a lubricating oil having satisfactory shear stability and capable of retaining a stable viscosity.

With respect to lubricating oils for transmission such as an automatic transmission fluid and the like, for example, there has hitherto been disclosed a lubricating oil composition for transmission containing a low-viscosity base oil (a kinematic viscosity at 100° C. is from 1.5 to 6 $mm^2/s$) and a poly(meth) acrylate not containing a long-chain alkyl group in a side chain thereof, which is considered to be a lubricating oil for transmission which has a low viscosity and which, despite this, is excellent in fatigue resistance or the like (see Patent Document 1).

But, in such a composition, even when the viscosity index is not thoroughly high (not more than 170), a lowering of the viscosity of the lubricating oil at a high temperature is large, so that there is a concern that the fatigue resistance is lowered. Also, an increase of the viscosity of the lubricating oil at a low temperature is large, so that there is a concern that the composition is inferior in fuel efficiency. Furthermore, transmission torque capacity, ability for preventing a gear change shock and the like are not investigated, and there is room for more improvements.

PRIOR ART DOCUMENT

Patent Document

[Patent Document 1] JP-A-2006-117852

SUMMARY OF THE INVENTION

Problem to be Solved by the Invention

Under such circumstances, an object of the present invention is to provide a lubricating oil composition for automatic transmission which has a high transmission torque capacity and satisfactory gear change shock characteristics and attains excellent fuel efficiency.

Also, another object of the present invention is to provide a lubricating oil composition for automatic transmission which is a lubricating oil having a low viscosity and a high viscosity index and which, despite this, not only has excellent shear stability and fatigue resistance (durability) but has a high transmission torque capacity and satisfactory gear change shock characteristics and attains excellent fuel efficiency.

Means for Solving the Problem

In order to develop a lubricating oil composition for transmission having the foregoing excellent performances, the present inventors made extensive and intensive investigations. As a result, it has been found that the foregoing objects can be attained by a composition containing a specified lubricant base oil, a specified viscosity index improver and a specified sulfur based compound. The present invention has been accomplished on the basis of such knowledge.

That is, the present invention provides:

(1) A lubricating oil composition for automatic transmission comprising (A) a lubricant base oil having a kinematic viscosity at 100° C. of from 1.5 to 20 $mm^2/s$, (B) a polymethacrylate based viscosity index improver, and (C) a sulfur based compound having an acid value of not more than 1.0 mgKOH/g and represented by the following general formula (1):

$$S—(CH_2CH_2COOR)_2 \quad (1)$$

(in the formula, R represents a hydrocarbon group having from 8 to 30 carbon atoms);

(2) The lubricating oil composition for automatic transmission as set forth above in (1), wherein the sulfur based compound (C) is a compound of the formula (1) wherein R represents a linear or branched alkyl group having from 12 to 15 carbon atoms;

(3) The lubricating oil composition for automatic transmission as set forth above in (1) or (2), wherein the lubricant base oil (A) is a mixture of (a-1) a mineral oil or a synthetic oil having a kinematic viscosity of from 1.5 to 3 $mm^2/s$ and (a-2) a mineral oil or a synthetic oil having a kinematic viscosity of from 5 to 20 $mm^2/s$;

(4) The lubricating oil composition for automatic transmission as set forth above in any one of (1) to (3), wherein the polymethacrylate based viscosity index improver (B) is (b-1) a polymethacrylate based viscosity index improver having a weight average molecular weight of from 10,000 to 50,000;

(5) The lubricating oil composition for automatic transmission as set forth above in any one of (1) to (4), wherein the polymethacrylate based viscosity index improver (B) contains (b-1) a polymethacrylate based viscosity index improver having a weight average molecular weight of from 10,000 to 50,000 and also (b-2) a polymethacrylate based viscosity index improver having a weight average molecular weight of from 100,000 to 1,000,000;

(6) The lubricating oil composition for automatic transmission as set forth above in any one of (1) to (5), containing one or two or more kinds of an alkaline earth metal based detergent selected among an alkaline earth metal sulfonate, an alkaline earth metal phenate and an alkaline earth metal salicylate; and a succinic acid imide based dispersant; and (7) The lubricating oil composition for automatic transmission as set forth above in any one of (1) to (6), wherein a viscosity index of the composition is 230 or more.

Effect of the Invention

According to the present invention, a lubricating oil composition for automatic transmission which has a high transmission torque capacity and satisfactory gear change shock characteristics and attains excellent fuel efficiency can be provided.

Also, according to the present invention, a lubricating oil composition for automatic transmission which is a lubricating oil having a low viscosity and a high viscosity index and which, despite this, not only has excellent shear stability and fatigue resistance (durability) but has a high transmission torque capacity and satisfactory gear change shock characteristics and attains excellent fuel efficiency can be provided.

MODES FOR CARRYING OUT THE INVENTION

In the lubricating oil composition for automatic transmission of the present invention, (A) a lubricant base oil having a kinematic viscosity at 100° C. of from 1.5 to 20 $mm^2/s$, preferably from 1.5 to 10 $mm^2/s$, and especially preferably from 2 to 5 $mm^2/s$ is used. When the kinematic viscosity at 100° C. of the lubricant based oil is less than 1.5 $mm^2/s$, an evaporation loss is large, so that there is a concern that a fatigue life of a metal is lowered. Also, when the kinematic viscosity at 100° C. exceeds 20 $mm^2/s$, a viscous effect is large, so that an effect for reducing fuel consumption is lowered. A mineral oil or a synthetic oil is used as the lubricant base oil.

For the purpose of enhancing the fatigue resistance of a metal while retaining a low viscosity, it is preferable to use, as the lubricant base oil in the present invention, a mixed base oil composed of a component (a-1) and a component (a-2).

A mineral oil or a synthetic oil having a kinematic viscosity at 100° C. of from 1.5 to 3 $mm^2/s$ is used as the foregoing component (a-1). When the kinematic viscosity at 100° C. of the component (a-1) is less than 1.5 $mm^2/s$, there is a concern that an evaporation loss becomes large, whereas when the kinematic viscosity at 100° C. exceeds 3 $mm^2/s$, the kinematic viscosity of the lubricant base oil (A) obtained by mixing the component (a-2) therewith cannot be reduced, so that there may be the case where the reduction in fuel consumption cannot be sufficiently achieved. In consequence, the kinematic viscosity at 100° C. of the component (a-1) is more preferably from 1.5 to 2.5 $mm^2/s$.

On the other hand, a mineral oil or a synthetic oil having a kinematic viscosity at 100° C. of from 5 to 20 $mm^2/s$ is used as the component (a-2). When the kinematic viscosity at 100° C. is less than 5 $mm^2/s$, there may be the case where the fatigue resistance of the lubricating oil cannot be sufficiently enhanced. Also, when the kinematic viscosity at 100° C. exceeds 20 $mm^2/s$, the kinematic viscosity of the lubricant base oil (A) cannot be sufficiently reduced, so that there may be the case where the reduction in fuel consumption cannot be achieved. In consequence, the kinematic viscosity at 100° C. of the component (a-2) is more preferably from 5 to 10 $mm^2/s$, and a still more preferably from 5 to 7 $mm^2/s$.

As each of the foregoing lubricant base oil (A) and the foregoing component (a-1) and component (a-2), a mineral oil or a synthetic oil satisfying each of the requirements regarding the kinematic viscosity is used.

Here, various mineral oils which are conventionally known are useful as the mineral oil, and for example, there are exemplified paraffin base mineral oils, intermediate base mineral oils, naphthene base mineral oils and the like. Specifically, there can be exemplified light-gravity neutral oils, medium-gravity neutral oils, heavy-gravity neutral oils or bright stocks by means of solvent refining, hydrogenation refining or the like, mineral oils obtained by isomerizing dewaxed wax or GTL wax, and the like.

Also, various synthetic oils which are conventionally known are useful, too as the synthetic oil. For example, there can be exemplified poly-α-olefins, polybutene, polyol esters, dibasic acid esters, phosphoric acid esters, polyphenyl ether, alkylbenzenes, alkylnaphthalenes, polyoxyalkylene glycols, neopentyl glycol, silicone oil, trimethylolpropane, pentaerythritol, hindered esters, and the like.

These mineral oils or synthetic oils can be used alone or in combination of two or more kinds thereof, and one or more kinds of a mineral oil and one or more kinds of a synthetic oil may also be combined and used.

It is preferable that each of the foregoing lubricant base oil and the foregoing mineral oil and synthetic oil satisfies each of the foregoing requirements regarding the kinematic viscosity and also has the following properties.

The viscosity index is preferably 80 or more, and more preferably 100 or more. When the viscosity index is 80 or more, a change in viscosity by a change of an oil temperature is small, and ability for forming an oil film at a high temperature can be kept satisfactory.

An aromatic content (% $C_A$) is preferably not more than 3, more preferably not more than 2, still more preferably not more than 1, and especially preferably not more than 0.5. When the % $C_A$ is not more than 3, oxidation stability can be enhanced.

Also, in view of the fact that the oxidation stability is enhanced, it is preferable that a sulfur content is not more than 0.01% by mass.

In the case where the lubricant base oil (A) of the present invention is a mixed base oil composed of the foregoing component (a-1) and component (a-2), with respect to a mixing proportion of the component (a-1) and the component (a-2), it is preferable that the former is from 50 to 70% by mass, with the latter being from 30 to 50% by mass, on the basis of a total amount of the lubricant base oil.

By using such a lubricant base oil (mixed base oil), despite a low viscosity, the fatigue resistance can be kept high.

In the present invention, a polymethacrylate based viscosity index improver is used as the component (B). The polymethacrylate based viscosity index improver includes so-called non-dispersion type polymethacrylates and dispersion type polymethacrylates. For example, a copolymer of a methacrylate and a nitrogen-containing monomer having an ethylenically unsaturated bond can be exemplified as the dispersion type methacrylate. Examples of the foregoing nitrogen-containing monomer having an ethylenically unsaturated bond include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone and mixtures thereof, and the like.

As such a polymethacrylate based viscosity index improver, those having a weight average molecular weight of from 10,000 to 1,000,000 can be used singly or in admixture of two or more kinds thereof.

By blending the polymethacrylate based viscosity index improver, the viscosity index of the composition can be effectively enhanced; the formation of a lubricating film which is efficient even at a high temperature is helped to suppress the generation of metal fatigue; and an increase of the viscosity at a low temperature is suppressed, thereby bringing an enhancement of fuel efficiency.

Among the foregoing polymethacrylate based index improvers, (b-1) a polymethacrylate based index improver having a weight average molecular weight of from 10,000 to 50,000 is preferable. When the weight average molecular weight is 10,000 or more, an effect for improving the viscosity index is exhibited; and when the weight average molecular weight is not more than 50,000, satisfactory shear stability is revealed, and initial performances of the composition can be retained over a long period of time.

Furthermore, it is more preferable to blend, as the foregoing polymethacrylate based viscosity index improver, (b-2) a polymethacrylate based viscosity index improver having a weight average molecular weight of from 100,000 to 1,000,000 together with the foregoing polymethacrylate based viscosity index improver (b-1) having a weight average molecular weight of from 10,000 to 50,000. By blending the (b-2) component together with the (b-1) component, the viscosity index of the composition can be more enhanced while retaining a shear stabilizing performance.

Though a blending amount of the polymethacrylate based viscosity index improver as the component (B) is not particularly restricted, in general, it is preferably in the range of from 1 to 20% by mass, and more preferably in the range of from 3 to 15% by mass on the basis of a total amount of the composition. When the blending amount of the component (B) is 1% by mass or more, an effect for improving the viscosity index is recognized; and when it is not more than 20% by mass, a lowering of the shear stability can be suppressed.

Also, in the case where the component (b-2) is blended together with the component (b-1) and used, a (b-1)/(b-2) ratio is preferably from 5/1 to 1/5, and more preferably from 4/1 to 1/4 in terms of a mass ratio.

When the (b-1)/(b-2) ratio is from 5/1 to 1/5 in terms of a mass ratio, not only a lowering of the shear stability can be suppressed, but an effect for improving the viscosity index can be enhanced.

In the present invention, a sulfur based compound having an acid value of not more than 1.0 mg-KOH/g and represented by the following general formula (1) is used as the component (C).

$$S—(CH_2CH_2COOR)_2 \quad (1)$$

(In the formula, R represents a hydrocarbon group having from 8 to 30 carbon atoms.)

From the viewpoints of easiness of availability and solubility, the hydrocarbon group having from 8 to 30 carbon atoms represented by R in the foregoing general formula (1) is a hydrocarbon group having preferably from 8 to 20 carbon atoms, more preferably from 12 to 18 carbon atoms, and especially preferably from 12 to 15 carbon atoms. Above all, a linear, branched or cyclic alkyl group, especially a linear or branched alkyl group is preferable.

Such a sulfur based compound can be, for example, synthesized from thiodipropionic acid and an alcohol having a hydrocarbon group having from 8 to 30 carbon atoms.

Specific examples of the sulfur based compound represented by the foregoing general formula (1) include those having an alkyl group having a branched chain, such as dioctyl thiodipropionate, di-2-ethylhexyl thiodipropionate, diisooctyl thiodipropionate, di-2,4,4-trimethylpentyl thiodipropionate, dinonyl thiodipropionate, diisononyl thiodipropionate, didecyl thiodipropionate, diisodecyl thiodipropionate, diundecyl thiodipropionate, diisoundecyl thiodipropionate, didodecyl thiodipropionate, diisododecyl thiodipropionate, ditridecyl thiodipropionate, diisotridecyl thiodipropionate, ditetradecyl thiodipropionate, diisotetradecyl thiodipropionate, dipentadecyl thiodipropionate, diisopentadecyl thiodipropionate, dihexadecyl thiodipropionate, diisohexadecyl thiodipropionate, diheptadecyl thiodipropionate, diisoheptadecyl thiodipropionate, dioctadecyl thiodipropionate, diisooctadeyl thiodipropionate, dieicosyl thiodipropionate, diisoeicosyl thiodipropionate and the like.

It is required that the sulfur based compound represented by the general formula (1) in the present invention is one having an acid value of not more than 1.0 mg-KOH/g, namely one whose acid value is adjusted to not more than 1.0 mg-KOH/g. When the acid value exceeds 1.0 mg-KOH/g, an effect for enhancing a coefficient of dynamic friction of the composition is lowered, so that a sufficient transmission torque capacity cannot be obtained. The sulfur based compound is more preferably one whose acid value is adjusted to not more than 0.5 mg-KOH/g.

Incidentally, the acid value is a value measured in conformity with JIS K2501.

Here, as a method of obtaining the sulfur based compound represented by the general formula (1) and having an acid value of not more than 1.0 mg-KOH/g, for example, in the case of synthesizing it by using thiodipropionic acid and an alcohol having a hydrocarbon group having from 8 to 30 carbon atoms, the synthesis may be performed under a condition under which a ratio of thiodipropionic acid does not become excessive relative to the alcohol while setting a ratio to 1.0 mole for thiodipropionic acid and 2.0 moles for the alcohol, respectively.

Though a blending amount of the foregoing component (C) is not particularly restricted, in general, it is preferably in the range of from 0.01 to 10% by mass, more preferably in the range of from 0.05 to 5% by mass, and especially preferably in the range of from 0.1 to 3% by mass on the basis of a total amount of the composition. When the blending amount of the component (C) is 0.01% by mass or more, the coefficient of dynamic friction is enhanced, and an increase of the transmission torque capacity is recognized; and when it is not more than 10% by mass, there is no concern that the oxidation stability is lowered.

In the present invention, for the purpose of enhancing friction characteristics, it is preferable to further blend an alkaline earth metal based detergent and a succinic acid imide based dispersant.

As the foregoing alkaline earth metal based detergent, an alkaline earth metal sulfonate, an alkaline earth metal phenate, an alkaline earth metal salicylate, an alkaline earth metal phosphonate and the like can be used. Above all, one or two or more kinds of an alkaline earth metal based detergent selected among alkaline earth metal sulfonates, phenates and salicylates are preferable.

Here, as the alkaline earth metal, calcium, magnesium, barium, strontium and the like can be used. From the viewpoints of easiness of availability and an effect for enhancing friction characteristics, calcium or magnesium is preferable, and calcium is especially preferable.

Also, though such an alkaline earth metal based detergent may be any of a neutral, basic or perbasic material, a basic or perbasic material is preferable. In particular, a base value (perchloric acid method) is preferably from 150 to 700 mg-KOH/g, and more preferably from 200 to 600 mg-KOH/g.

In consequence, one or two or more kinds of an alkaline earth metal detergent selected among calcium sulfonate, magnesium sulfonate, calcium phenate and calcium salicylate, all of which have a base value of from 150 to 700 mg-KOH/g, can be especially suitably used.

A blending amount of such an alkaline earth metal detergent is in general from about 0.05 to 10% by mass, and preferably from 0.1 to 5% by mass on the basis of a total amount of the composition.

It is preferable that an alkyl group or alkenyl group-substituted succinic acid imide (monoimide type or bisimide type) having an average molecular weight of from 1,000 to 3,500 or a derivative thereof is used as the foregoing succinic acid imide based dispersant.

Examples of the derivative of the foregoing succinic acid imide based dispersant include boron-containing hydrocarbon-substituted alkyl group or alkenyl group-substituted succinic acid imides.

A blending amount of such a succinic acid imide based dispersant is in general from about 0.05 to 10% by mass, and preferably from 0.1 to 5% by mass on the basis of a total amount of the composition.

In the present invention, an extreme pressure agent, an antifriction agent, an oil additive, an antioxidant, a rust preventive, a metal inactivating agent, a defoaming agent and the like can be blended.

Examples of the foregoing extreme pressure agent or antifriction agent include organometallic compounds such as zinc dithiophosphate (ZnDTP), zinc dithiocarbamate (ZnDTC), sulfurized oxymolybdenum organophosphorodithioate (MoDTP), sulfurized oxymolybdenum dithiocarbamate (MoDTC) and the like. A blending amount thereof is in general from 0.05 to 5% by mass, and preferably from 0.1 to 3% by mass on the basis of a total amount of the lubricating oil composition.

Also, examples of the oil additive include aliphatic saturated or unsaturated monocarboxylic acids such as stearic acid, oleic acid and the like; polymerized fatty acids such as dimer acids, hydrogenated dimer acids and the like; hydroxy fatty acids such as ricinoleic acid, 12-hydroxystearic acid and the like; aliphatic saturated or unsaturated monoalcohols such as lauryl alcohol, oleyl alcohol and the like; aliphatic saturated or unsaturated monoamines such as stearylamine, oleylamine and the like; aliphatic saturated or unsaturated monocarboxylic acid amides such as lauric acid amide, oleic acid amide and the like; and so on.

A blending amount of such an oil additive is preferably in the range of from 0.01 to 10% by mass, and especially preferably in the range of from 0.1 to 5% by mass on the basis of a total amount of the lubricating oil composition.

Examples of the antioxidant include an amine based antioxidant, a phenol based antioxidant, a sulfur based antioxidant and the like.

As the amine based antioxidant, for example, there can be exemplified monoalkyldiphenylamine based antioxidants such as monooctyldiphenylamine, monononyldiphenylamine and the like; dialkyldiphenylamine based antioxidants such as 4,4'-dibutyldiphenylamine, 4,4'-dipenyldiphenylamine, 4,4'-dihexyldiphenylamine, 4,4'-diheptyldiphenylamine, 4,4'-dioctyldiphenylamine, 4,4'-dinonyldiphenylamine and the like; polyalkyldiphenylamine based antioxidants such as tetrabutyldiphenylamine, tetrahexyldiphenylamine, tetraoctyldiphenylamine, tetranonyldiphenylamine and the like; and naphthylamine based antioxidants such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine and the like. Above all, dialkyldiphenylamine based antioxidants are preferable.

As the phenol based antioxidant, for example, there can be exemplified monophenyl based antioxidants such as 2,6-di-tert-butyl-4-methylphenol, 2,6-di-tert-butyl-4-ethylphenol and the like; and diphenol based antioxidants such as 4,4'-methylenebis(2,6-di-tert-butylphenol), 2,2'-methylenebis(4-ethyl-6-tert-butylphenol) and the like.

As the sulfur based antioxidant, for example, there can be exemplified phenothiazine, pentaerythritol-tetrakis-(3-laurylthiopropionate), bis(3,5-tert-butyl-4-hydroxybenzyl)sulfide, thiodiethylenebis(3-(3,5-di-tert-butyl-4-hydroxyphenyl))propionate, 2,6-di-tert-butyl-4-(4,6-bis(octylthio)-1,3,5-triazine-2-m ethylamino)phenol and the like.

As to such an antioxidant, a single kind thereof may be used alone, or two or more kinds thereof may be combined and used. Also, a blending amount thereof is chosen within the range of usually from 0.01 to 10% by mass, and preferably from 0.03 to 5% by mass on the basis of a total amount of the lubricating oil composition.

Examples of the rust preventive include alkyl or alkenyl succinic acid derivatives such as dodecenyl succinic acid half ester, octadecenyl succinic acid anhydride, dodecenyl succinic acid amide and the like; polyhydric alcohol partial esters such as sorbitan monooleate, glycerin monooleate, pentaerythritol monooleate and the like; amines such as rosin amine, N-oleyl sarcosine and the like; dialkyl phosphite amine salts; and the like. As to such a rust preventive, a single kind thereof may be used alone, or two or more kinds thereof may be combined and used.

A blending amount of such a rust preventive is preferably in the range of from 0.01 to 5% by mass, and especially preferably in the range of from 0.05 to 2% by mass on the basis of a total amount of the lubricating oil composition.

As the metal inactivating agent, for example, there can be used benzotriazole based compounds, thiadiazole based compounds, gallic acid ester based compounds and the like. A blending amount of such a metal inactivating agent is preferably in the range of from 0.01 to 0.5 by mass, and especially preferably in the range of from 0.01 to 0.2% by mass on the basis of a total amount of the lubricating oil composition.

As an example of the defoaming agent, liquid silicones are suitable, and examples thereof include methyl silicone, fluorosilicone and polyacrylates.

A preferred blending amount of such a defoaming agent is from 0.0005 to 0.01% by mass on the basis of a total amount of the lubricating oil composition.

The lubricating oil composition for automatic transmission of the present invention is not only a lubricating oil composition for automatic transmission which has a high transmission torque capacity and satisfactory gear change shock characteristics and attains excellent fuel efficiency but a lubricating oil composition for automatic transmission which is a lubricating oil having a low viscosity and a high viscosity index and which, despite this, not only has excellent shear stability and fatigue resistance (durability) but has a high transmission torque capacity and satisfactory gear change shock characteristics and attains excellent fuel efficiency.

In consequence, in the composition (lubricating oil composition for automatic transmission) of the present invention, the kinematic viscosity at 100° C. is preferably not more than 7.0 $mm^2/s$, and the viscosity index is preferably 230 or more, and more preferably 240 or more.

EXAMPLES

Next, the present invention is described in more detail by reference to the Examples, but it should not be construed that the present invention is limited to these Examples.

Incidentally, physical properties of base oils and compositions were determined according to the following methods.

<Base Oil and Lubricating Oil Composition>

(1) Kinematic Viscosity (40° C. and 100° C.)

Measured in conformity with JIS K2283.

(2) Viscosity Index (VI):

Measured in conformity with JIS K2283.

(3) Sulfur Content:

Measured in conformity with JIS K2541.

<Lubricating Oil Composition>

(4) Shear Stability:

A kinematic viscosity at 100° C. of a composition after shearing for 96 hours using a KRL shear tester was measured in conformity with DIN 52350-6.

(5) Gear Durability Test (Fatigue Life):

A fatigue life was evaluated by means of an FZG gear test under the following experimental condition according to the following evaluation standard.

(Experimental Condition)

Running-in: Load: 6 stages, oil temperature: 60° C., experiment time: 2 hours

Run proper: Load: 9 stages, oil temperature: 90° C.

(Evaluation Standard)

A time (hours) until a fatigue trace of 5 mm was generated was measured as a fatigue life.

(6) Transmission Clutch Friction Characteristics:

A friction experiment of 5,000 cycles was performed using an SAE No. 2 tester in conformity with the JASO Standards M348-2002 under the following experimental condition.

(Experimental Condition)

Surface pressure: 1 MPa

Oil temperature: 100° C.

Number of revolutions: 3,600 rpm

Frictional material: Cellulose based material

Endurance cycle: 5,000

(Evaluation Method)

$\mu_{1800}$ and $\mu_{200}$ at the time of termination of 5,000 cycles were measured, from which was then calculated $\mu_{200}/\mu_{1800}$. The larger the $\mu_{1800}$, the higher the transmission torque capacity is, and the smaller the $\mu_{200}/\mu_{1800}$, the more satisfactory the gear change shock preventing properties are.

Examples 1 to 5 and Comparative Examples 1 to 5

Base oils and additives shown in Table 1 were used and blended in a proportion shown in Table 1 to prepare a transmission fluid composition, and properties and performances thereof were measured. The results are shown in Table 1.

TABLE 1

| | | | | Example 1 | Example 2 | Example 3 | Example 4 | Example 5 | Comparative Example 1 | Comparative Example 2 |
|---|---|---|---|---|---|---|---|---|---|---|
| Blending proportion (% by mass) | Base oil | Mineral oil 1 [1)] | | 60.0 | 58.7 | 60.4 | 60.0 | 60.0 | 60.0 | 60.0 |
| | | Mineral oil 2 [2)] | | 19.6 | 19.6 | 16.3 | 19.6 | 15.7 | 19.6 | 20.1 |
| | PMA | PMA1 [3)] | | 8.9 | 9.8 | 9.0 | 8.9 | 15.9 | 8.9 | 8.9 |
| | | PMA2 [4)] | | — | 3.5 | — | — | — | — | — |
| | | PMA3 [5)] | | — | — | 5.9 | — | — | — | — |
| | | PMA4 [6)] | | 3.1 | — | — | 3.1 | — | 3.1 | 3.1 |
| | Sulfur compound | Sulfur based additive 1 [7)] | | 0.5 | 0.5 | 0.5 | — | 0.5 | — | — |
| | | Sulfur based additive 2 [8)] | | — | — | — | 0.5 | — | — | — |
| | | Sulfur based additive 3 [9)] | | — | — | — | — | — | 0.5 | — |
| | Other additive [10)] | | | 7.92 | 7.92 | 7.92 | 7.92 | 7.92 | 7.92 | 7.92 |
| Kinematic viscosity at 100° C. of lubricant base oil ($mm^2/s$) | | | | 3.0 | 3.0 | 2.9 | 3.0 | 2.9 | 3.0 | 3.0 |
| Properties of composition | Kinematic viscosity ($mm^2/s$) | | 40° C. | 24.9 | 26.0 | 23.9 | 24.9 | 26.3 | 24.8 | 24.8 |
| | | | 100° C. | 6.74 | 6.78 | 6.66 | 6.74 | 6.70 | 6.74 | 6.74 |
| | Viscosity index | | | 253 | 240 | 261 | 251 | 230 | 253 | 253 |
| | Element concentration in oil (% by mass) | | Ca | 0.04 | 0.04 | 0.04 | 0.04 | 0.04 | 0.04 | 0.04 |
| | | | S | 0.08 | 0.08 | 0.08 | 0.08 | 0.08 | 0.08 | 0.08 |
| | | | N | 0.16 | 0.16 | 0.16 | 0.16 | 0.16 | 0.16 | 0.16 |
| Evaluation results | SAE No. 2 test (friction characteristics at the time of termination of 5,000 cycles) | | $\mu_{1800}$ | 0.132 | 0.133 | 0.134 | 0.132 | 0.133 | 0.119 | 0.125 |
| | | | $\mu_{200}$ | 0.115 | 0.119 | 0.117 | 0.116 | 0.117 | 0.106 | 0.11 |
| | | | $\mu_{200}/\mu_{1800}$ | 0.871 | 0.895 | 0.873 | 0.879 | 0.880 | 0.891 | 0.880 |
| | KRL shear test (kinematic viscosity at 100° C. after 96 hours) | | $mm^2/s$ | 4.86 | 5.26 | 4.92 | 4.87 | 5.40 | 4.86 | 4.87 |

TABLE 1-continued

| | | Example 1 | Example 2 | Example 3 | Example 4 | Example 5 | Comparative Example 1 | Comparative Example 2 |
|---|---|---|---|---|---|---|---|---|
| FZG gear test (time of generation of fatigue trace of 5 mm or more) | hrs | 85 | 103 | 85 | 83 | 93 | 83 | 85 |

[Note]

1) Mineral oil 1: 60N hydrogenated refined oil, kinematic viscosity at 100° C.: 2.2 $mm^2/s$, viscosity index: 109, % Cp: 79.1, density (at 15° C.): 0.8212 $g/cm^3$ 2) Mineral oil 2: 150N hydrogenated refined oil, kinematic viscosity at 100° C.: 6.0 $mm^2/s$, viscosity index: 121, % Cp: 79.2, density (at 15° C.): 0.8423 $g/cm^3$ 3) PMA1: Polymethacrylate (non-dispersion type), weight average molecular weight: 30,000

4) PMA2: Polymethacrylate (non-dispersion type), weight average molecular weight: 120,000

5) PMA3: Polymethacrylate (non-dispersion type), weight average molecular weight: 270,000

6) PMA4: Polymethacrylate (non-dispersion type), weight average molecular weight: 500,000

7) Sulfur compound 1: Ditridecyl thiodipropionate, acid value: 0.3 mg-KOH/g

8) Sulfur compound 2: Ditridecyl thiodipropionate, acid value: 0.8 mg-KOH/g

9) Sulfur compound 3: Ditridecyl thiodipropionate, acid value: 1.2 mg-KOH/g

10) Other additives: Containing an antioxidant (mixture of a phenol based antioxidant and an amine based antioxidant), Ca sulfonate having a base value of 300 mg-KOH/g, polybutenylsuccinic acid imide, a metal inactivating agent, a defoaming agent and the like.

As is noted from Table 1, in all of the lubricating oil compositions (Examples 1 to 5) of the present invention, the $\mu_{1800}$ exceeds 0.130, so that the transmission torque capacity is high; and at the same time, the $\mu_{200}/\mu_{1800}$ is not more than 0.90, so that the ability for preventing a gear change shock is satisfactory. Also, not only the kinematic viscosity at 100° C. after shearing is 4.8 $mm^2/s$ or more, so that the shear stability is excellent, but the fatigue life in the FZG gear test is 80 hours or more, so that the durability is excellent, too. Furthermore, the viscosity index of the composition is high as 230 or more.

On the other hand, in the compositions of Comparative Examples 1 and 2 in which the component (C) of the present invention is not blended, the $\mu_{1800}$ is not more than 0.125, so that the transmission torque capacity is low, and it is difficult to attain the problem of reduction in fuel consumption.

INDUSTRIAL APPLICABILITY

The lubricating oil composition for automatic transmission of the present invention is not only a lubricating oil composition for automatic transmission which has a high transmission torque capacity and satisfactory gear change shock characteristics and attains excellent fuel efficiency but a lubricating oil composition for automatic transmission which is a lubricating oil having a low viscosity and a high viscosity index and which, despite this, not only has excellent shear stability and fatigue resistance (durability) but has a high transmission torque capacity and satisfactory gear change shock characteristics and attains excellent fuel efficiency.

In consequence, it can be efficiently utilized as a lubricating oil composition for automatic transmission capable of effectively contributing to reduction in fuel consumption.

The invention claimed is:

1. A lubricating oil composition comprising:

(A) a lubricant base oil having a kinematic viscosity at 100° C. of from 1.5 to 20 $mm^2/s$;

(B) a polymethacrylate-containing viscosity index improver which comprises (b-1) a polymethacrylate-containing viscosity index improver having a weight average molecular weight of from 10,000 to 50,000 and (b-2) a polymethacrylate-containing viscosity index improver having a weight average molecular weight of from 100,000 to 270,000, in which a mass ratio (b-1)/(b-2) is from 4 to 0.25; and (C) a sulfur-containing compound having an acid value of not more than 1.0 mg-KOH/g and having formula (1):

$$S(CH_2CH_2COOR)_2 \quad (1)$$

wherein R is a hydrocarbon group comprising from 8 to 30 carbon atoms, and wherein the composition comprises the polymethacrylate-containing viscosity index improver (B) in an amount of 3 to 15% by mass, based on a total amount of the composition, and the composition comprises the sulfur-containing compound in an amount of 0.1 to 3% by mass, based on the total amount of the composition.

2. The composition of claim 1, wherein the lubricant base oil (A) comprises:

(a-1) a mineral oil or a synthetic oil having a kinematic viscosity at 100° C. of from 1.5 to 3 $mm^2/s$; and (a-2) a mineral oil or a synthetic oil having a kinematic viscosity at 100° C. of from 5 to 20 $mm^2/s$.

3. The composition of claim 1, further comprising:

at least one alkaline earth metal comprising detergent selected from the group consisting of an alkaline earth metal sulfonate, an alkaline earth metal phenate, and an alkaline earth metal salicylate; and a succinic acid imide comprising dispersant.

4. The composition of claim 1, having a viscosity index of 230 or more.

5. The composition of claim 2, further comprising:

at least one alkaline earth metal comprising detergent selected from the group consisting of an alkaline earth metal sulfonate, an alkaline earth metal phenate, and an alkaline earth metal salicylate; and a succinic acid imide comprising dispersant.

6. The composition of claim 2, having a viscosity index of 230 or more.

7. The composition of claim 1, wherein the lubricant base oil has a kinematic viscosity at 100° C. of from 1.5 to 10 $mm^2/s$.

8. The composition of claim 1, wherein the lubricant base oil has a kinematic viscosity at 100° C. of from 2 to 5 $mm^2/s$.

9. The composition of claim 1, wherein the lubricant base oil (A) comprises:

(a-1) a mineral oil or a synthetic oil having a kinematic viscosity at 100° C. of from 1.5 to 2.5 $mm^2/s$; and (a-2) a mineral oil or a synthetic oil having a kinematic viscosity at 100° C. of from 5 to 7 $mm^2/s$.

10. The composition of claim 1, wherein R in formula (1) is a hydrocarbon group comprising from 8 to 20 carbon atoms.

11. The composition of claim 1, wherein R in formula (1) is a hydrocarbon group comprising from 12 to 18 carbon atoms.

12. The composition of claim 1, wherein R in formula (1) is a hydrocarbon group comprising from 12 to 15 carbon atoms.

13. The composition of claim 1, wherein R in formula (1) is a linear alkyl group.

14. The composition of claim 1, wherein R in formula (1) is a branched alkyl group.

15. The composition of claim 1, wherein the acid value of the sulfur-containing compound is not more than 0.5 mg-KOH/g.

16. The composition of claim 1, wherein the sulfur-containing compound is tridecyl dithiopropionate.

* * * * *